United States Patent [19]

Block et al.

[11] 4,285,171

[45] Aug. 25, 1981

[54] ABRASIVE FLAP DRUM

[75] Inventors: Aleck Block, Los Angeles; Hiroshi Hasegawa, Whittier, both of Calif.

[73] Assignee: Merit Abrasive Products, Inc., Compton, Calif.

[21] Appl. No.: 30,331

[22] Filed: Apr. 16, 1979

[51] Int. Cl.[3] ..... B24D 13/04

[52] U.S. Cl. ..... 51/337; 51/293; 15/230.12

[58] Field of Search ..... 15/230.12, 230.14, 230.15, 15/230.16, 230.17, 230.18, 230.19; 51/330–337, 376, 394, 401–406, 293, 297

[56] References Cited

U.S. PATENT DOCUMENTS

| | | | |
|---|---|---|---|
| 2,524,626 | 10/1950 | Harman | 51/337 |
| 2,599,961 | 6/1952 | White | 51/337 |
| 2,826,776 | 3/1958 | Peterson | 51/336 X |
| 3,548,551 | 12/1970 | Block | 51/337 |
| 3,619,948 | 11/1971 | Burns | 51/334 X |
| 3,914,908 | 10/1975 | Belanger | 51/334 |
| 4,080,714 | 3/1978 | Emerson | 51/334 X |

*Primary Examiner*—Gary L. Smith
*Assistant Examiner*—Robert P. Olszewski
*Attorney, Agent, or Firm*—Charles H. Schwartz; Ellsworth R. Roston

[57] ABSTRACT

An abrasive pack for use with an elongated hub having a plurality of spaced slots each extending along the length of the drum and with a plurality of the abrasive packs each extending outwardly from the drum and each positioned adjacent an individual one of the slots, each pack including a plurality of abrasive flaps of abrasive material stacked together to form a pack, the abrasive flaps each including a plurality of slits located periodically along the length of the flaps and with each slot extending partially along the height of the flap for increasing the flexibility of the flaps to bending and twisting, an attachment member means having an end portion and a loop portion; a supporting strip positioned adjacent the sides of the end portion of the attachment member to support and retain the end portions; the supporting strip including a plurality of slits located periodically along the length of the strip and with each slit extending partially along the height of the strip for increasing the flexibility of the strip to bending and twisting, and the supporting strip and the end portion disposed between individual flaps in the pack and with the loop portion without the pack for reception within an individual one of the slots for locking the loop portion within the slot.

23 Claims, 8 Drawing Figures

FIG. 5
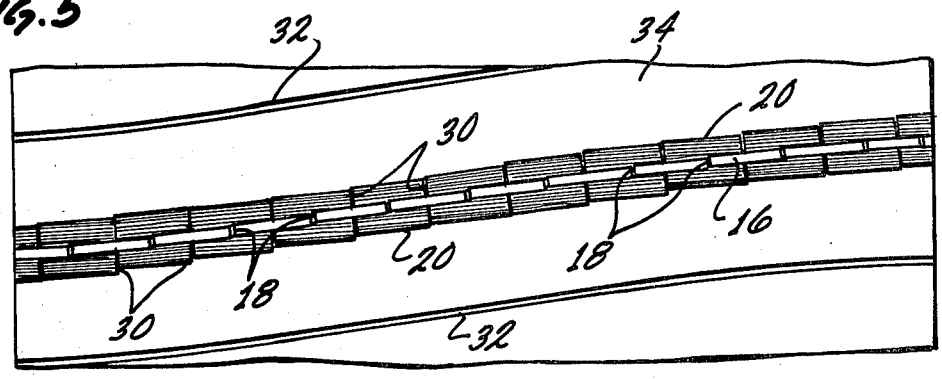
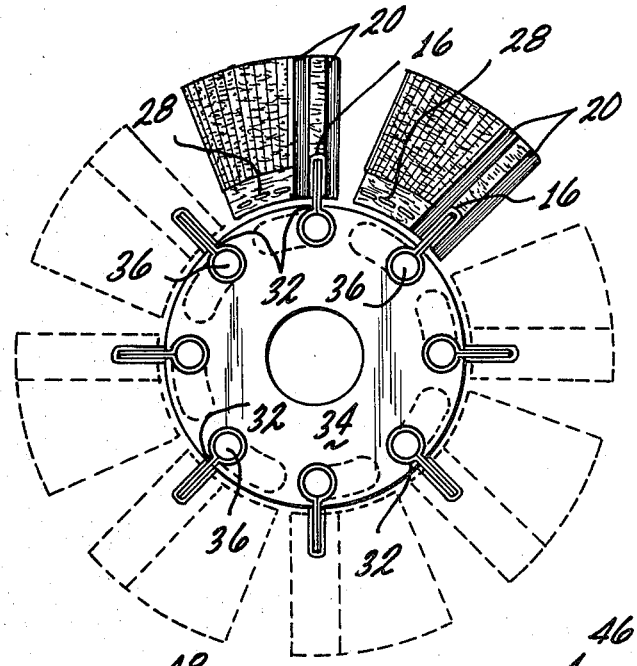
FIG. 6
FIG. 7
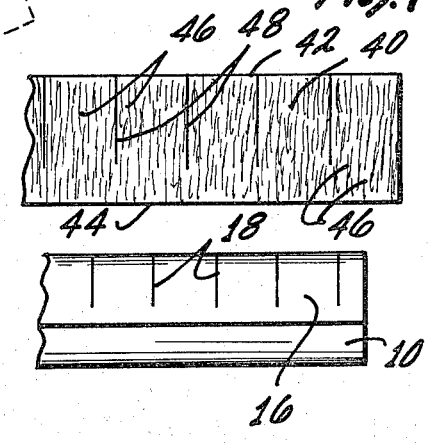
FIG. 8
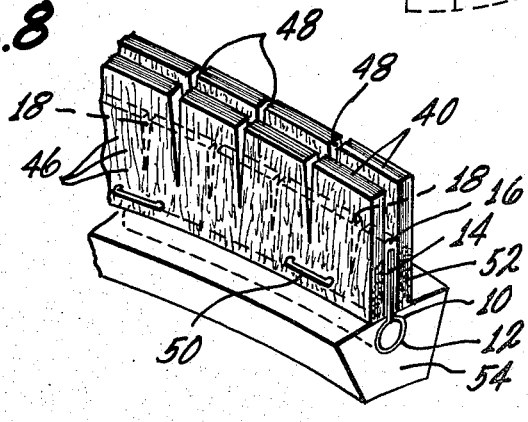

ABRASIVE FLAP DRUM

The present invention is directed to an abrasive flap drum for providing for an abrasive action over a wide surface. Specifically, the present invention relates to means for mounting the abrasive packs to extend from the surface of a rotatable hub member. Generally, the rotatable hub includes a plurality of slots extending across the hub and with attachment means extending from each of the abrasive packs to be positioned within and retained by the slots.

In the present invention, the slots on the rotatable hub member have a helical configuration to extend across and partially angularly around the the circumference of the hub. The attachment means includes a loop constructed of a flexible material and with an end portion of the loop located between individual flaps of abrasive material forming the packs.

In a particular embodiment of the invention, the end portion of the loop is supported on both sides by a U-shaped sheet of supporting material such as metal. The sheet of supporting metal is slit at periodic positions along its length so as to more easily adapt to the helical configuration of the slot. In addition or alternatively, the individual flaps of abrasive material may be slit at the periodic positions along their length, again, to facilitate the abrasive pack following the helical configuration of the slots in the hub. The slits through the flaps may be in line with each other to facilitate the portions of the flaps separating so as to follow the helical configuration.

Large abrasive flap drums are currently used in industry for a number of purposes and with these flap drums providing for the abrasion over a relatively wide area. For example, the abrasive flap drums are being increasingly used to descale hot rolled scale from steel. In the prior art the metal scale would be descaled by a chemical acid bath. These acid baths cause fumes and there are environmental problems with disposal of the acid baths after each use. In addition, the effectiveness of the acid baths decreases with use. In order to overcome these problems, abrasive flap drums are being used to provide for the descaling.

Other uses for the abrasive flap drum have been in the rolling of metal strip such as aluminum sheet, into longer and thinner sheets. The rolling process is accomplished by using a large roll which exerts pressure on the sheet so as to form the sheet to progressively thinner and longer dimensions. As the roll contacts the aluminum sheet, it picks up base metal and oxide particles from the surface of the sheet. These particles would be returned to the sheet to mar the surface of the rolled sheet, unless the particles are cleaned from the roll at a position away from the contact with the aluminum sheet. An abrasive flap drum is located away from the aluminum sheet and at a position to contact the surface of the roll. The abrasive flap drum is rotated relative to the roll and provides for cleaning of the oxide particles and any other contaminents from the surface of the roll.

The individual packs are formed by cutting segments of a roll of abrasive material into individual flaps and with a plurality of flaps forming each individual pack. As disclosed in a first copending application Ser. No. 023,733 listing Alex Block as the inventor and assigned to the same assignee as the instant case, the abrasive material of the prior art devices typically has abrasive particles coated on the surface of a backing fabric. The backing fabric includes long and strong cloth fibers (warp), extending in a longitudinal direction along the length of the original roll of abrasive material. In the prior art devices, the flaps are cut from the roll of abrasive material and with each flap formed by cutting across the roll and against the long and strong fibers. As disclosed in the copending application, the flaps would tend to curl.

As disclosed in the first copending application, the individual flaps may be cut from the large roll of abrasive material so that the face width dimensions of each flap is in the direction of the length of the roll. Specifically, the individual flaps are cut from the roll in a longitudinal direction, and by so cutting the flaps, the long and strong fibers tend to impede the curling of the abrasive flaps.

As a further improvement in the construction of the abrasive flap drum as disclosed in the copending application, the flaps which make up the packs are cut with curved sides to have a banana shape. The slots in the hub are formed with a helical configuration to receive the attachment means for the individual flaps. The cutting of the flaps with curved sides facilitates the positioning of the attachment means for the packs in the helical slots in the hub. This is because the helical slots in the hub provide for a curved shape for each slot as the slot extends helically across and around the periphery of the hub.

It is advantageous to use the helical slots since helically disposed packs on the hub provide for a number of advantages in the operation of the abrasive flap drum. Specifically, with the helical disposition of the packs, only one position of each flap hits the workpiece at each instant. The position of contact between the flap and workpiece moves along the length of the flap as the abrasive drum is rotated and the contact transfer from the end of one flap to the opposite end of the next flap during rotation. The progressively changing contact position minimizes the force upon the workpiece at each instant and also provides for a continuous uniform contact between the abrasive flaps and the workpiece, so as to provide for a smooth abrasive action. In addition, the progressive contact reduces the slapping of the flaps against each other and thereby reduces the noise.

In the first copending application, the abrasive flaps may be attached to the hub using a loop of sheet material. As disclosed in a second copending application, Ser. No. 030,332, listing Hiroshi Hasegawa as the inventor and assigned to the same assignee as the instant case, an improved attachment means is disclosed. In the second copending application, the attachment means includes a thin sheet of supporting material adjacent the sides of the end portion of the loop. The thin sheet may be folded into a U-shape, so as to press the two end portions of the loop together. In the second copending application, the thin sheet of supporting material may be made of metal and may also be used with an attachment means formed as a solid root member, such as a solid plastic member.

In the second copending application, the thin supporting sheet provides support for the free end portion of the loop and also for the base portions of the abrasive pack and reinforces the base portion to prevent the staples or stitches from pulling through the flaps. This structure, therefore, tends to solidify the base portions of the packs to give more stability to these base portions. However, since the supporting means is made from a thin sheet of material such as aluminum, the supporting means are still resilient and bendable and can, therefore, respond on a compliant basis to the force exerted on the abrasive packs by the workpiece.

In the second copending application, the supporting means may be used with the abrasive packs formed from flaps cut with curved sides. In this instance, the supporting strip may be made resilient and bendable enough so that the strip can adapt to the curved sides and can twist so that the supporting strip will follow the helical configuration of the helical slot in the hub. It is, of course, desirable that the supporting strip be able to twist at progressive positions along the length of the strip. This is because each abrasive pack faces in progressively different directions along its length since the helical slot causes each progressive position of the pack to have a different angular circumferential direction.

In the present invention, the supporting strip is slit at progressive positions along the length of the strip so as to facilitate the bending and twisting of the strip, and to insure that the strip will more accurately follow the helical configuration of the slot in the hub. This arrangement also allows for the use of a thicker, and therefore stronger supporting strip so as to provide for a sufficient support of relatively heavy abrasive material. For example, such heavy abrasive material may be used in the descaling of metal scale from steel. As the attachment means, including the supporting strip, is bent and twisted so as to follow the helical configuration of the slot, this provides for the slits to open into a V-shape and with adjacent sections of the supporting strip displaced slightly from each other.

In the attachment means of the present invention, the attachment means may be used with flaps of abrasive material which are cut from the roll of abrasive material either with or against the warp of the backing fabric. Also, the flaps of abrasive material may be cut with either straight or curved sides.

The present invention is also directed to the slitting of the flaps at periodic positions so as to facilitate the bending and twisting of the abrasive material to follow the helical configuration of the slot. The positions of slitting for the flaps of abrasive material may be intermediate the positions of slitting for the supporting strip, when the flaps are used with the slitted attachment means. The alternate slitting will tend to overcome any problems of tearing the entire abrasive pack, such as might happen if the slits were in the same location for both the flaps of abrasive material and the supporting strip.

If the flaps are initially cut with curved sides, then the slits will provide for displacement of adjacent portions of the leaves as the abrasive packs conform to the helical configuration of the slots. If the flaps are cut with straight sides, then the slits will open to provide for V-shaped openings as the flaps conform to the helical configuration of the helical slots in the drum. The slits in the flaps may be in line with each other so as to facilitate the portions of the flaps separating so as to follow the helical configuration.

The use of the slits in the flaps forming the abrasive packs may also tend to localize the forces on the packs. This is because any variation in the force on the pack will affect only one slitted portion of the pack and will not be transmitted very strongly to an adjacent portion of the pack.

Providing for the slits in the supporting strip as described above, will eliminate the need for the use of an adhesive such as epoxy at the base of the abrasive flaps. In the prior art, epoxy was used to support the packs at the base portion of the packs. By eliminating the use of the epoxy, the abrasive packs of the present invention are much more supple and can adapt to the proper curved shape to conform to the helical slots in the hub. Specifically, the use of the slits in the supporting strip and in the flaps of the abrasive packs, both provide for the conforming of the abrasive packs to the proper curved shape. However, it is to be appreciated that the base portions of the abrasive packs may include an adhesive such as epoxy, but with each abrasive pack held in a helical fixture as the adhesive sets, so that the proper helical twist is present in the abrasive pack.

A clearer understanding of the present invention will be had with reference to the following description in drawings, wherein FIG. 1 illustrates a perspective view of the attachment means of the present invention and slit at periodic positions so as to increase the flexibility;

FIG. 5 illustrates a top view of the abrasive pack of FIGS. 3 and 4 and positioned within a helical slot in a rotary hub;

FIG. 6 illustrates an end view of the rotary hub with a plurality of abrasive packs of the present invention;

FIG. 7 illustrates a view of the components for an abrasive pack wherein the abrasive flaps have straight sides; and FIG. 8 illustrates a perspective view of a completed abrasive pack using the components of FIG. 7, and held in a fixture to conform to the helical configuration of the slot in the hub while adhesive at the base portion of the pack sets.

Figure 1:
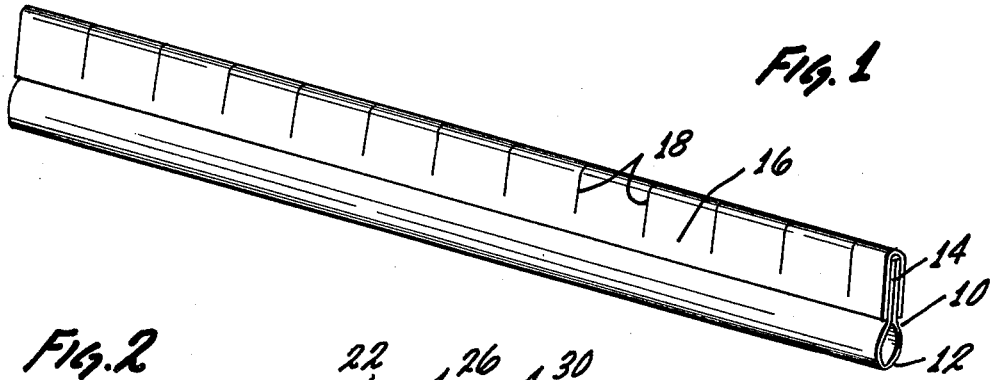

FIG. 1 illustrates an attachment means for an abrasive pack, constructed in accordance with the teachings of the present invention. As shown in FIG. 1, the attachment means include a member 10, including a loop portion 12 and end portions 14. The member 10 may be constructed of a sheet material such as neoprene-impregnated fabric, but it is to be appreciated that other structures may be used for the member 10. For example, the member 10 may be constructed of a plastic material and the loop portion 12 may be either hollow or solid. Generally, the member 10 is constructed of material which is flexible in nature, so that the member 10 may be used with a helical slot in a hub.

Adjacent the end portions 14 of the member 10 is a supporting strip 16. As shown in FIG. 1, the supporting strip 16 has a U-shaped configuration which presses together and supports the end portions 14. The supporting strip 16 includes a plurality of slits 18 and with the slits 18 at periodic positions along the length of the supporting strip 16. The slits are cut through the supporting strip and extend partially along the height of the strip. The supporting strip 16 may be constructed of sheet metal, such as aluminum sheet but may be constructed of other materials such as plastic material, which are generally more dense and less flexible than the member 10. The slits 18 may be only through the supporting strip 16 and need not be through the end portions 14 of the member 10, but the slits may be through both the supporting strip 16 and the end portions 14.

Figure 2:
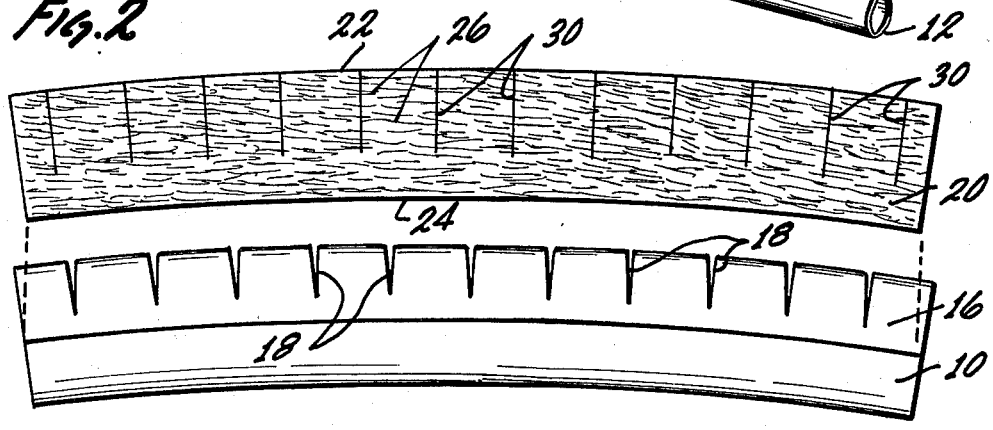
FIG. 2 illustrates a side view of the attachment means of FIG. 1 and bent so as to conform to the shape of a curved abrasive flap.

In FIG. 2 a stack of flaps 20 of abrasive material, forming an abrasive pack, is shown adjacent the attachment means of FIG. 1. Specifically, each individual flap 20 of abrasive material is shown to have curved sides 22 and 24. The flap 20 is formed by a backing sheet of fabric and with abrasive particles 26 disposed on the backing sheet. The curved sides 22 and 24 are cut in a direction running with the warp of the fabric of the backing sheet.

In order to have the attachment means match the curved configuration of the curved sides of the flaps 20 of abrasive material, the attachment means is shown to be bent to have the same curved configuration as the curved sides 22 and 24. When the attachment means is bent, the slits 18 are opened to form a V-shaped configuration.

Figure 3:
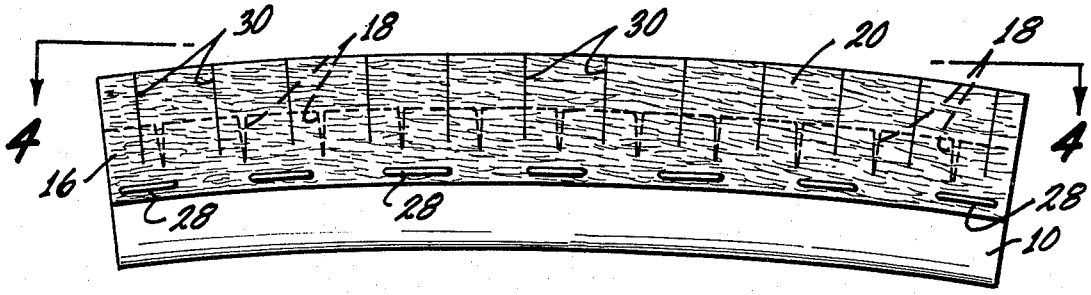
FIG. 3 illustrates a side view of a completed abrasive pack using the components of FIG. 2.
Figure 4:
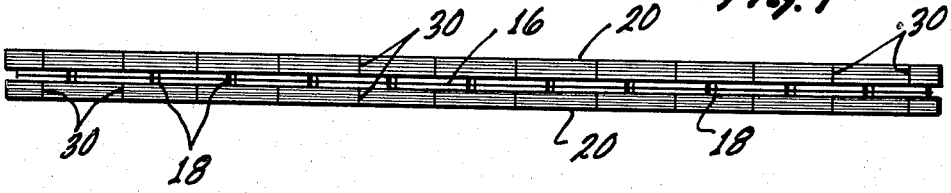
FIG. 4 illustrates a top view of the abrasive pack of FIG. 3, taken along lines 4—4 of FIG. 3.

FIGS. 3 and 4 illustrate a completed abrasive pack, using a plurality of flaps 20 arranged on either side of the attachment means. Specifically, the abrasive flaps 20 and the attachment means are held together, using staples 28. It is to be appreciated that other means may be used, such as stitching to hold the various elements together. As shown in FIGS. 2, 3 and 4, the flaps 20 of abrasive material also include slits 30, located at periodic positions along the length of the flaps. The slits extend through the flaps and partially along the height of the flaps. Slitting of the flaps 20 allows a greater flexibility of the flaps to conform to a helical slot in a hub. The slits 30 through the entire stack of flaps 20 are in line so as to allow freedom of movement between adjacent portions of the stack of flaps.

It can be seen that the slits 30 in the flaps 20 of abrasive material are located at positions intermediate the positions for the slits 18 in the supporting strip 16. The alternating of the position of the slits distributes the weak points, so that a completed abrasive pack will not be liable to tearing along a common slit in the flaps and the supporting strip. The slits in the abrasive flaps also tend to localize any forces produced on the flaps when stacked together to form the abrasive pack and when abrading a workpiece. Any variation in force will affect only one slitted portion of the pack, and will not be transmitted as strongly to adjacent portions.

As shown in FIGS. 5 and 6, the completed abrasive packs may be positioned to extend from one of a plurality of helical slots 32 in a rotary hub 34. The helical slots extend across the hub 34 and also extend partially around the hub. As shown in FIG. 6, the slots 32 have a circular cross section along their length and terminating in a narrow opening at the periphery of the rotary hub 34. The loop portion 12 of the attachment means is disposed in the slot 32 and with a flexible rod 36 passing through the loop so as to lock the loop in position. Because the supporting strip 16 is slit at the positions 18, this allows the supporting strip to more easily bend so as to follow the helical configuration. In addition, the slits 30 in the flaps 20 also allows the resultant pack of abrasive flaps 20 to follow the helical configuration.

FIGS. 7 and 8 illustrate another embodiment of the invention, using an attachment means substantially identical to that shown in FIG. 1. Specifically, the attachment means includes the member 10, having a loop portion 12 and end portions 14. A supporting strip 16 of material such as aluminum, has a U-shaped configuration to support and press the end portions 14 together. A plurality of slits 18 extend at periodic positions along the length of a supporting strip 16.

A plurality of flaps 40 of abrasive material are cut with straight sides 42 and 44. In addition, the flaps 40 may be cut from a roll of abrasive material and with the flaps cut to have the sides 42 and 44 running perpendicular to the warp of the backing fabric 46 of the abrasive material. The flaps 40 include slits 48 located at periodic positions along the length of the flaps and with the slits 48 located intermediate the position of the slits 18 in the supporting strip 16.

As shown in FIG. 8, the various components may be held together, such as by staples 50, to produce a completed pack and with an epoxy material 52 disposed at the base of the pack. In FIG. 8, the pack is shown bent and twisted as it is held in a fixture 54 having a helical slot and as the epoxy 52 cures so as to follow the helical configuration of the slot, such as the slot 32, shown in FIG. 5. When the pack is bent and twisted as the epoxy 52 cures so as to follow the helical configuration of the slot, the slits 48 in the flaps 40, as well as the slits 18 in the supporting strip 16, assume a V-shaped configuration. This provides for the additional flexibility to allow for the abrasive packs to conform to the helical configuration of the slot. The use of the slits in the abrasive pack and the supporting strip may allow for the use of heavier materials, but still allowing for the abrasive pack to follow the helical configuration.

The present invention, therefore, may be used, either with or without an adhesive such as epoxy at the base of the pack. If an adhesive such as epoxy is not used, the supporting strip provides sufficient support to the base of the flaps. The elimination of the epoxy allows for the abrasive packs to be more supple in use and the use of the slits allows the abrasive pack to adapt to the proper curved shape to match the helical configuration of the slots in the drum. However, if an adhesive such as epoxy is used, the abrasive pack may be preset to the desired configuration by the use of the fixture having the helical slot matching the helical slot in the hub. As indicated above, the slits in the pack also tend to localize any work forces on the pack, so that variations in force would normally affect only one slitted portion of a pack.

Although the invention has been described with reference to particular embodiments, it is to be appreciated that various adaptations and modifications may be made and the invention is only to be limited by the appended claims.

We claim:

1. An abrasive pack for use with an elongated hub having a plurality of spaced slots each extending along the length of the drum and with a plurality of the abrasive packs each extending outwardly from the drum and each positioned adjacent an individual one of the slots, each pack including a plurality of abrasive flaps of abrasive material stacked together to form a pack;

an attachment member means having an end portion and a loop portion;

a supporting strip positioned adjacent the sides of the end portion of the attachment member to support and retain the end portion;

the supporting strip including a plurality of slits located periodically along the length of the strip and with each slit extending partially along the height of the strip for increasing the flexibility of the strip to bending and twisting, and the supporting strip and the end portion disposed between individual flaps in the pack and with the loop portion without the pack for reception within an individual one of the slots for locking the loop portion within the slot.

2. The abrasive pack of claim 1 wherein the supporting strip is constructed of aluminum sheet material.

3. The abrasive pack of claim 1 wherein the supporting strip is U-shaped and with the end portion of the attachment member received within and filling the open end of the U-shaped supporting strip.

4. The abrasive pack of claim 1 wherein the attachment member is formed from sheet material and with the loop portion formed as an open loop.

5. The abrasive pack of claim 1 wherein the individual slots are each formed as a helix with progressive positions of each slot rotated angularly and with the abrasive flaps forming each pack having a plurality of slits located periodically along the length of each flap and with each slit extending partially along the height of each flap for increasing the flexibility of each flap to bending and twisting.

6. The abrasive pack of claim 5 wherein the slits in the flaps are intermediate the slits in the supporting strip.

7. The abrasive pack of claim 1 wherein the individual slots are each formed as a helix with progressive positions of each slot rotated angularly and the flaps have curved edges in the direction along the length of the slot to follow the curvature of the helix.

8. The abrasive pack of claim 1 wherein the flaps forming each pack have a plurality of slits located periodically along the length of each flap and with each slit extending partially along the height of each flap for increasing the flexibility of each flap to bending and twisting and with the slits in adjacent flaps in line for allowing adjacent portions of each pack to separate.

9. An abrasive flap drum, including an elongated hub having a plurality of spaced slots each extending along the length of the hub and with each slot formed as a helix with progressive positions of each slot rotated angularly, a plurality of abrasive packs and with each pack formed of a plurality of abrasive flaps of abrasive material stacked together and with the plurality of the abrasive packs each extending outwardly from the hub and with each pack positioned adjacent an individual one of the slots, each of the abrasive flaps forming each pack having a plurality of slits located periodically along the length of each flap and with each slit extending partially along the height of each flap for increasing the flexibility of each flap to bending and twisting, and attachment means for each pack and with each attachment means including an end portion and a loop portion, a supporting strip positioned adjacent the sides of the end portion of each attachment means to support and retain the end portion, and with the supporting means including a plurality of slits cut part way along the height of the strip and with the slits at periodic positions along the length of the strips, and the end portion including the supporting strip for disposition against individual flaps in the pack to have the loop portion extend outside the pack and with the loop portion retained within an individual one of the slots for locking the loop portion within the slot.

10. The abrasive flap drum of claim 9 wherein the supporting strip is constructed of thin aluminum sheet material.

11. The abrasive flap drum of claim 9 wherein the supporting strip is U-shaped and with the end portion of the attachment means received within and filling the open end of the U-shaped supporting strip.

12. The abrasive flap drum of claim 9 wherein the slits in the flaps are intermediate the slits in the strip.

13. The abrasive flap drum of claim 9 wherein each attachment means is formed from a sheet material and with the loop portion formed as an open loop and with a rod member passing through the rod to lock the loop within the slot.

14. The abrasive flap drum of claim 9 wherein the abrasive flaps forming each pack include adhesive material at the base of the pack and with a helical twist in the pack preset as the adhesive sets.

15. The abrasive flap drum of claim 9 wherein the individual flaps have curved edges in the direction along the length of the slot to follow the curvature of the helix.

16. The abrasive flap drum of claim 9 wherein the slits in the adjacent flaps are in line for allowing adjacent portions of each pack to separate.

17. A method of making an abrasive pack for use with a hub having a plurality of spaced helical supporting means each extending along the length of the hub and with progressive positions of each supporting means rotated angularly to form each helix, including the following steps providing a stack of abrasive flaps and with each flap formed as abrasive particles disposed on a backing sheet, slitting each flap at progressive positions along the length for providing separate slitted portions for each flap, providing an attachment means including a first portion coupled to the stack of abrasive flaps and including means for coupling to one of the helical supporting means extending along the hub, disposing adhesive material within the end of the stack of abrasive flaps adjacent the attachment means, and bending and twisting the stack of abrasive flaps to a helical configuration and with slitted portions separating to follow the curvature of the helical supporting means as the adhesive sets to preform the abrasive pack to the helical configuration.

18. The method of making the abrasive pack of claim 17 including the step of cutting the abrasive flaps with curved edges to facilitate the stack of abrasive flaps following the helical configuration of the helical supporting means.

19. The method of making the abrasive pack of claim 17 including the step of slitting the first portion of the attachment means at progressive positions along its length for facilitating the abrasive pack following the helical configuration.

20. The method of making the abrasive pack of claim 17 wherein the slits in adjacent flaps are slitted in line with each other.

21. A method of making an abrasive pack for use with a hub having a plurality of spaced helical supporting means each extending along the length of the hub and with progressive positions of each supporting means rotated angularly to form each helix, including the following steps, providing a stack of abrasive flaps and with each flap formed as abrasive particles disposed on a backing sheet, providing an attachment means coupled to the stack of abrasive flaps and including means for coupling to one of the helical supporting means extending along the hub, slitting the attachment means at progressive positions along its length for providing separate slitted portions for the attachment means, disposing adhesive material within the end of the stack of abrasive flaps adjacent the attachment means, and bending and twisting the stack of abrasive flaps to a helical configuration and with the slitted portions of the attachment means separating to follow the curvature of the helical supporting means as the adhesive sets to preform the abrasive pack to the helical configuration.

22. The method of making the abrasive pack of claim 21 including the step of cutting the abrasive flaps with curved edges to facilitate the stack of abrasive flaps following the helical configuration of the helical supporting means.

23. The method of making the abrasive pack of claim 21 including the step of slitting the abrasive flaps at progressive positions along their length for facilitating the abrasive pack following the helical configuration.

* * * * *